United States Patent [19]

Brueckner et al.

[11] 4,311,135

[45] Jan. 19, 1982

[54] APPARATUS TO ASSIST LEG VENOUS AND SKIN CIRCULATION

[76] Inventors: Gerald G. Brueckner, 16135 Timberview, Fraser, Mich. 48026; Edward Cantrell, 31251 Beechwood, Warren, Mich. 48093

[21] Appl. No.: 89,142

[22] Filed: Oct. 29, 1979

[51] Int. Cl.[3] ..... A61H 1/00

[52] U.S. Cl. ..... 128/24 R; 128/64

[58] Field of Search ..... 128/24 R, 24.2, 60, 128/61, 64, 38, 39, 40, 297, 299

[56] References Cited

U.S. PATENT DOCUMENTS

| | | | |
|---|---|---|---|
| 2,345,073 | 3/1944 | Rosett | 128/60 |
| 2,528,843 | 11/1950 | Poor | 128/24 R |
| 2,781,041 | 2/1957 | Weinberg | 128/60 |
| 3,177,866 | 4/1965 | Wesslund | 128/24 R |
| 3,179,106 | 4/1965 | Meredith | 128/64 |
| 3,920,006 | 11/1975 | Lapidus | 128/64 |
| 4,013,069 | 3/1977 | Hasty | 128/64 |
| 4,193,149 | 3/1980 | Welch | 128/38 |
| 4,197,837 | 4/1980 | Tringali et al. | 128/40 |

FOREIGN PATENT DOCUMENTS

| | | | |
|---|---|---|---|
| 481481 | 11/1950 | Italy | 128/24 R |

*Primary Examiner*—Robert W. Michell
*Assistant Examiner*—Arthur S. Rose
*Attorney, Agent, or Firm*—Gifford, VanOphem, Sheridan & Sprinkle

[57] ABSTRACT

An apparatus to assist leg venous and skin circulation is provided and comprises a stocking which is secured around at least a portion of a leg of a person. The stocking includes a plurality of elongated and flexible tubular members so that each member defines an elongated and expandable fluid chamber. The stocking is arranged so that each fluid chamber extends substantially circumferentially around the person's leg and the members are axially adjacent each other. The apparatus further comprises an air distributor for sequentially fluidly pressurizing the chambers, maintained the pressure in each chamber for a predetermined period and thereafter exhausting the fluid pressure from the chambers. The air distributor performs this pressurization of the chambers in the stocking sequentially in a cephalad direction to thereby propel the leg venous blood towards the heart.

12 Claims, 9 Drawing Figures

66
48
40
102
62
112
88
104
80
120
124
122
82
52
60
72
28
A
198
200
202
204

APPARATUS TO ASSIST LEG VENOUS AND SKIN CIRCULATION

BACKGROUND OF THE INVENTION

I. Field of the Invention

The present invention relates generally to human body circulatory aids and, more particularly, to an apparatus to assist leg venous and skin circulation.

II. Description of the Prior Art

Thrombophlebitis is the development of organized blood clots in the veins and immobilization of the patient is a major cause for thrombophlebitis. Such immobilization can occur, for example, from an acute injury, illness requiring protracted confinement to bed or can result from a chronic disease. In these situations, stasis occurs which leads to the development of thrombosis and partial or even complete vascular occlusion. This in turn can disadvantageously result in the possible development of pulmonary embolization and also significantly adds to the development of post-phlebitis syndrome.

In approximately 95 percent of the reported cases, exclusive of nursing homes, convalescence homes and death at home, thrombophlebitis develops in the lower extremities. The occurrence of thrombophlebitis varies from approximately ten to eighty (10% to 80%) percent of the patients hospitalized and depends to a great extend upon the age and pre-existing conditions of the patient among other factors. Of the patients contracting thrombophlebitis, pulmonary embolism is reported to occur in the range of ten to seventy (10% to 70%) percent of these patients and 15 percent of all patients developing pulmonary embolism die ultimately as a result.

Prolonged patient immobolization also results in decubitus ulcers which develop in the skin over pressure points due primarily to inadequate blood circulation. Such pressure points are, for example, present over the bony projection of the elbows, ankles, hips and vertebra which undergo ulceration. These ulcers frequently become infected and require surgical removal and prolonged treatment. A severe infection may even lead to septicemia which requires aggressive therapy and occasionally results in the death of the patient.

In order to combat thrombophlebitis, it has been the previous practice to place a board at the feet of a bedridden patient. The patient is then instructed to periodically push against the board which aids in leg venous and skin circulation due to the resulting muscle activity. This solution, however, has proven to be inadequate and only partially effective in operation. Moreover, the previously known solution requires active participation by the patient which is not always obtainable.

Other treatments for thrombophlebitis have also included heparin therapy and the use of an elastic stocking to limit expansion of the leg veins. Previously known treatments for decubitus ulcers have included the use of cushions and periodic rotation of the patient. These various treatments, however, have proven less than satisfactory.

SUMMARY OF THE PRESENT INVENTION

The present invention provides an apparatus to assist in leg venous and skin circulation which is simple to apply and use and which requires no patient participation.

In brief, the apparatus according to the present invention comprises a stocking which is secured to the lower leg portion of the patient by any suitable means. The stocking itself comprises a plurality of elongated tubular and flexible members each defining an elongated and tubular fluid chamber. The tubular members are arranged within the stocking so that each tubular member extends substantially circumferentially around the leg of the patient and so that the tubular members are axially adjacent, and preferably immediately adjacent, each other.

The apparatus of the present invention further includes a unique fluid distributor means connected to a source of fluid pressure for sequentially fluidly pressurizing the chambers, maintaining the pressure in each chamber for a predetermined period of time and thereafter exhausting the pressure from each chamber. The air distributor includes a plurality of fluid pressure outlets, each of which is connected to one of the chambers in the stocking, and the sequential pressurization of the stocking chambers is conducted in a cephalic direction. In this fashion, the sequential pressurization of the chambers within the stocking compresses the leg veins and propels the venous blood in a cephalic direction or towards the heart thus assisting the leg venous and skin circulation.

In the preferred form of the invention, the pressure distributor comprises a housing having an interior pressurized chamber and through which a shaft is rotatably mounted and driven. The shaft in turn is drivingly connected to a distributor plate which flatly and sealingly abuts against a port plate having a plurality of circumferentially spaced fluid ports formed through it. A port and slot arrangement through the distributor plate sequentially registers with the ports in the port plate so that the fluid pressure within the housing chamber is sequentially connected to the port in the port plate. These fluid ports in turn are each connected to separate chambers in the stocking.

The port plate also includes a plurality of exhaust ports which are spaced radially inwardly from the outlet ports and these outlet ports are open exteriorly of the housing. The rotating distributor plates also include a radially extending slot which selectively connects the outlet ports to the exhaust ports in the ported plate sequentially upon the rotation of the distributor plate.

Thus, the pressurization of each stocking chamber and the exhaustion of the fluid pressure from each stocking chamber is accomplished through the same fluid conduit.

In the preferred form of the invention, the sequential pressurization and exhaustion of the fluid pressure from the stocking chambers occurs only throughout a portion of the rotation of the distributor plate, preferably 135 degrees, so that a rest period occurs before the sequential pressurization of the stocking chambers is repeated. Likewise, in the preferred form of the invention, one stocking is secured to each leg of the patient. However, it is preferred that the sequential pressurization of the stocking chambers in one leg is offset from the other leg and, because of this, a separate air distributor is used for each leg stocking.

BRIEF DESCRIPTION OF THE DRAWINGS

A better understanding of the present invention will be had upon reference to the following detailed description when read in conjunction with the accompanying drawings, wherein like reference characters refer to like parts throughout the several views, and in which.

DETAILED DESCRIPTION OF THE PRESENT INVENTION

Figure 1:
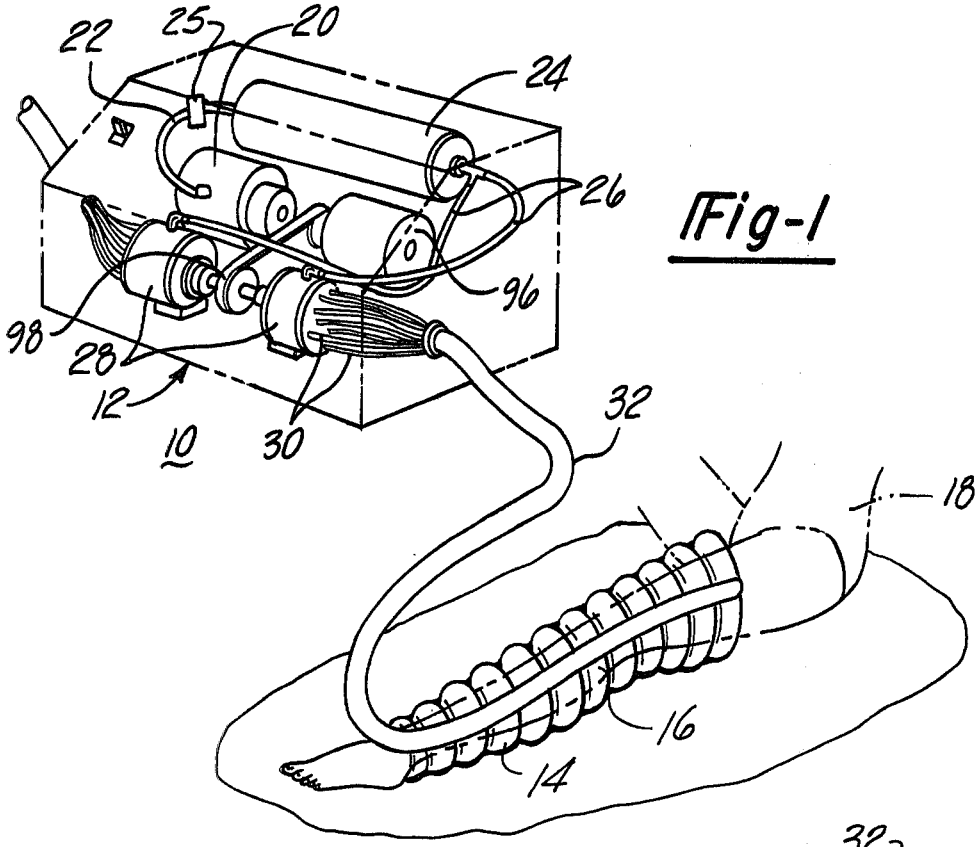
FIG. 1 is a diagrammatic view illustrating the operation of the device of the present invention.
Figure 2:
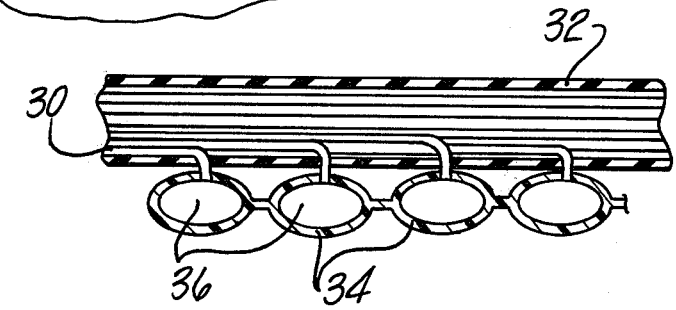
FIG. 2 is a fragmentary sectional view illustrating the construction of the stocking.

Referring first to FIGS. 1 and 2, the device 10 of the present invention for assisting leg venous and skin circulation is thereshown and generally comprises a fluid pressurizing and distributing means 12 which is fluidly connected in a manner to be subsequently described in greater detail to a stocking 14 which is secured to the lower leg 16 of a patient 18 by any suitable means. The fluid employed by the device 10 is preferably air and thus, for simplicity, will be hereinafter referred to as air, it being understood that no undue limitation should be drawn therefrom.

The air pressurizing and distributing means 12 further comprises an air compresser 20 having its outlet connected by a conduit 22 to an air accumulator 24 via a suitable regulator 25. The air accumulator 24 merely comprises a large chamber and is designed to avoid pressure fluctuations in the system. Alternatively, of course, the compressor 20 can be replaced by an available source of pressurized air, commonly found in hospitals and other medical facilities.

The outlet from the accumulator 24 is in turn connected by fluid conduits 26 to a pair of air distributors 28 which are substantially identical in construction and mirror images of each other. Thus only one air distributor 28 will be hereinafter described in detail.

Still referring to FIGS. 1 and 2, in a manner which will also be subsequently described in great detail, the air distributor 28 sequentially fluidly connects the air pressure from the accumulator 24 to a plurality of fluid conduits 30 which extend from the air distributor 28, through a sheathing 32 and to the stocking 14. The stocking 14, in turn, is constructed from a plurality of flexible tubular members 34 which extends circumferentially about the leg portion of the patient 18 and are immediately axially adjacent each other. Each tubular member 34 defines an interior fluid chamber 36 and one of the conduits 30 from the air distributor 28 is fluidly connected to each of these fluid chambers 36. Thus, as fluid pressure is connected to one of the chambers 36 in the stocking tubular members 34, the tubular member 34 expands accordingly and compresses its respective circumferential area about the patient's leg 16. Subsequent exhaustion of the air pressure from the chamber 36 in turn permits the tubular member 34 to contract. Moreover, the pressurization of the chambers 36 is relatively small, for example 40 millibars, to permit sufficient compression of the leg veins without compressing the leg arteries. In addition, the tubular members 34 may include small pores (not shown) which permit a small amount of air to exhaust from the chambers 36, when pressurized, to provide cooling for the patient's leg 14.

Figure 3:
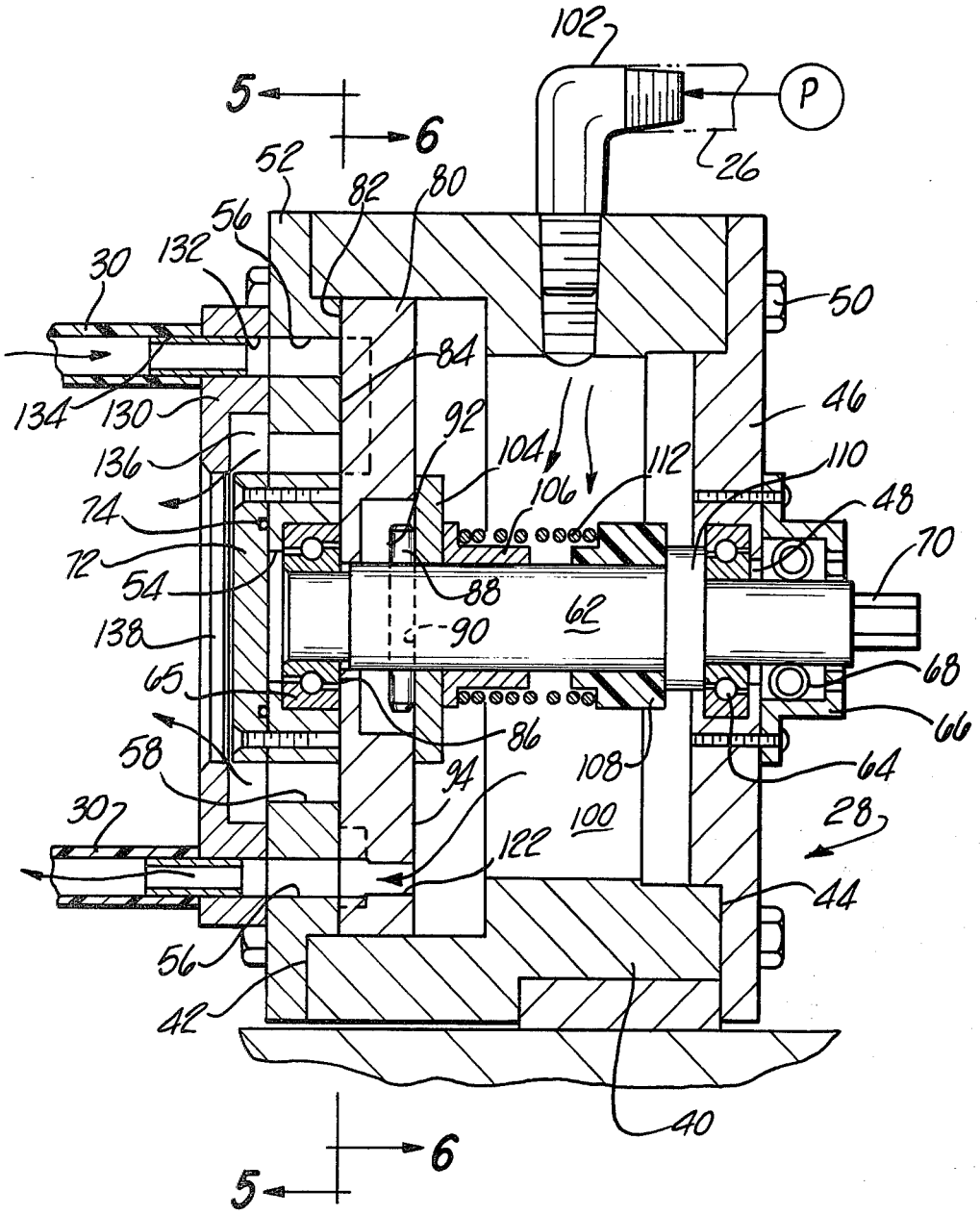
FIG. 3 is a longitudinal sectional view illustrating the air distributor means of the present invention.
Figures 4, 7, 8, 9:
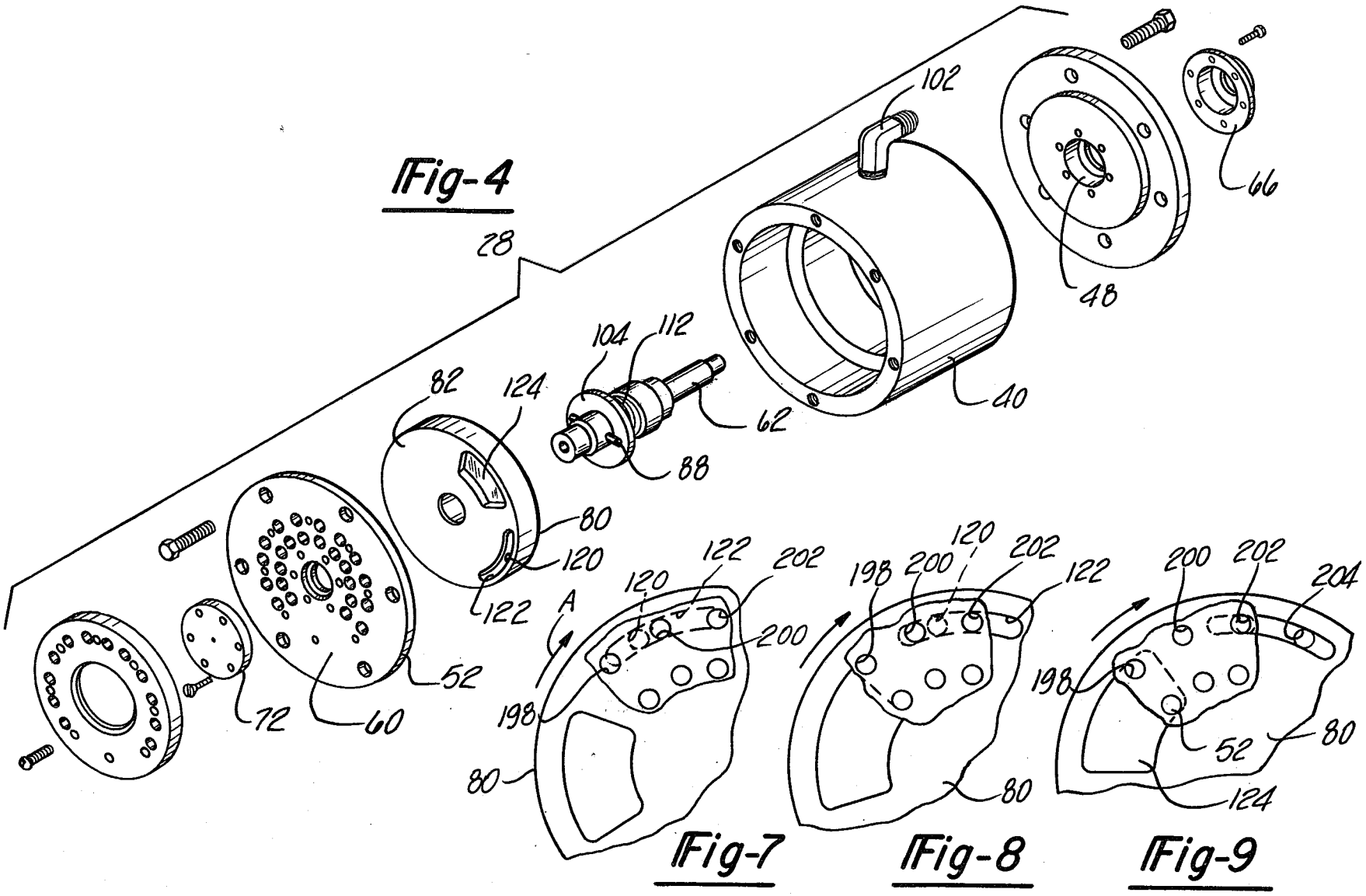
FIG. 4 is an exploded perspective view of the air distributor means of the present invention.
FIGS. 7–9 are fragmentary plan views illustrating the operation of the air distributor means.

Referring now to FIGS. 3 and 4, the air distributor 28 for sequentially connecting the air pressure source with the conduits 30 is thereshown in greater detail and comprises a housing 40 which is tubular and cylindrical in shape and open at each end 42 and 44. A circular end plate 46 having a central throughbore 48 is secured by bolts 50 and encloses the end 44 of the housing 48. A suitable gasket (not shown) is provided between the end plate 46 and the housing 40 to form a fluid tight seal.

Figure 5:
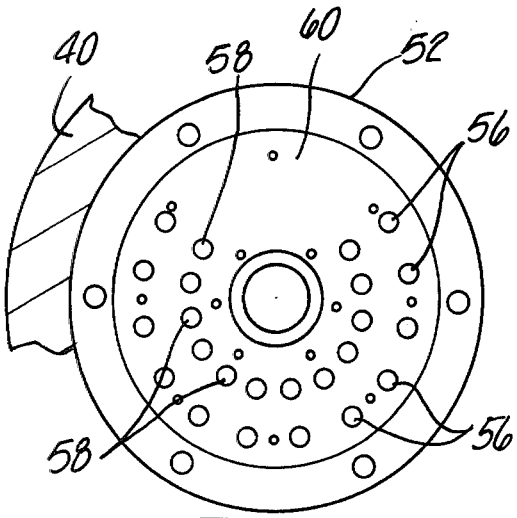
FIG. 5 is a plan view illustrating one component of the air distributor means and taken along line 5—5 in FIG. 5.

Referring now to FIGS. 3 and 5, a circular port plate 52 having a central throughbore 54 is scured to and encloses the other axial end 42 of the housing 40. Unlike the end plate 46, however, the port plate 52 includes a plurality of circumferentially equidistantly spaced pressure ports 56 formed axially through it. Likewise, a plurality of circumferentially spaced exhaust ports 58 are formed through the port plate 52 and are spaced radially inwardly from the pressure ports 56. Moreover, both the pressure ports 56 and the exhaust ports 58 are formed only around approximately 225 degrees of the circumference of the port plate 52 thus forming a dead space area 60 of approximately 135 degrees in circumferential length. The function of the pressure ports 56 and exhaust ports 58 will be subsequently described.

Referring again to FIGS. 3 and 4, a shaft 62 is rotatably mounted axially through the housing by bearings 64 and 65 positioned within the end plate throughbore 48 and port plate throughbore 54, respectively. A cup 66 with an airseal 68 is secured to the end plate 46 around the shaft 62 so that the shaft 62 has a portion 70 extending axially outwardly through the end plate thoughbore 48 while still maintaining a fluid seal between the shaft 62 and the housing 40. Conversely, the throughbore 54 through the port plate 52 is closed by a cap 72 having a suitable fluid seal 74.

A circular air distributor plate 80 is positioned within the interior of the housing 40 so that one axial end surface 82 of the plate 80 flatly abuts against the inner axial end surface 84 of the port plate 52. Preferably, both surfaces 82 and 84 are lapped so that these surfaces 82 and 84 flatly and sealing abut against each other. In addition, the distributor plate 80 is preferably constructed of a material different from the port plate 52, such as brass and steel, respectively, to prevent galling as the distributor plate 80 is rotated.

The distributor plate 80 further includes a central bore 86 through which the shaft 62 extends. In addition, the shaft 62 is drivingly connected to the distributor plate 80 by means of a pin 88 which extends through a transverse hole 90 in the shaft 62 and is received in a slot 92 formed in the inner end face 94 of the distributor plate 80. Consequently, rotation of the shaft 62 by a motor 96 (FIG. 1) via a pully arrangement 98 (FIG. 1) rotatably drives the air distributor plate 80 within the interior of the housing 40. In addition, the distributor plate 80 in conjunction with the housing 40 and end plate 46 forms a closed interior chamber 100 within the housing which is connected to the conduit 26 from the pressure source by a conventional fluid fitting 102.

To insure that the air distributor plate 80 flatly abuts against the port plate 52, a washer 104 and a pair of spring collars 106 and 108 are positioned around the shaft 62 and entrapped between the pin 88 and an enlarged portion 110 on the shaft 62 so that the washer 104 abuts against the inner axial end 94 of the air distributor plate 80. A helical spring 112 in the state of compression is positioned in between the collars 106 and 108 and thus urges the air distributor plate 80 against the port plate 52.

Figure 6:
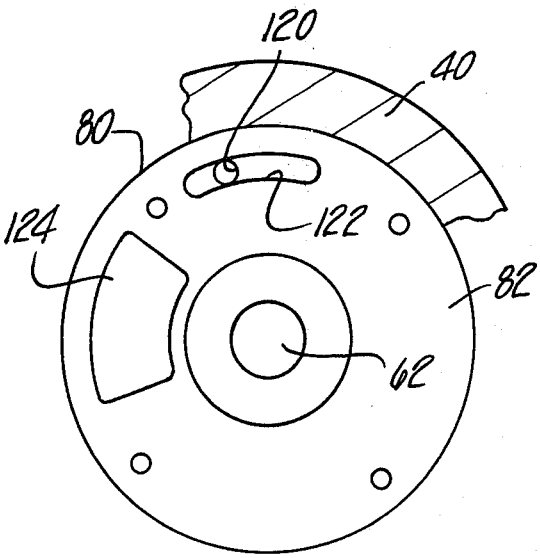
FIG. 6 is a plan view illustrating a further component of the air distributor means and taken along line 6—6 in FIG. 3.

Referring now particularly to FIGS. 4 and 6, the air distributor plate 80 includes a pressure port 120 which registers with a circumferentially extending slot 122 on the lapped surface 82 of the distributor plate 80. Both the port 120 and slot 122 are formed in or through the plate 80 at a radial distancefrom the shaft 62 equal to the pressure ports 56 (FIG. 5) in the port plate 52 so that the slot 122 registers with the pressure ports 56. In addition, the air distributor plate 80 further includes a recess 124 on its axial end surface 82 at a position circumferentially spaced from the slot 122. Unlike the slot 122, however, the recess 124 is not only circumferentially elongated but also extends radially inwardly toward the center of the distributor plate 80 so that its radially outer end registers with the pressure ports 56 in the port plate 52 while its inner radial end registers with the exhaust ports 58 in the port plate 52. Thus, depending on the rotational position of the distributor plate 80, the recess 124 fluidly connects with the pressure ports 56 with the exhaust ports 58 in the port plates 52.

Referring again to FIGS. 3 and 4, an annular tube junction member 130 is secured to the exterior surface of the port plate 52 and includes a plurality of bores 132 therethrough, each of which registers with one of the port pressure boards 156. The fluid lines 30 which are connected to the stocking 14 are then connected to the pressure ports 56 in the port plate 52 via tube inserts 134 which are press fit into the junction member 130. The junction member 130 also includes an annular recess 136 and a central bore 138 which are open to the exhaust ports 58 in the port plate 52. Thus air exhausting through the exhaust ports 58 freely exhaust to the atmosphere exteriorly of the air distributor 28.

The fluid lines 30 extending between the junction member 130 and the stocking sequentially connect the ports 56 in the port plate 52 with the tubular members 34 in the stocking 14. In other words, and with reference to FIGS. 1 and 5, the fluid pressure ports 56 in the port plate going in a clockwise direction are sequentially connected to the tubular members 34 from the bottom of the stocking 14 and towards its top.

The component parts of the device 10 according to the present invention having been described, its operation will now be described with reference to a single air distributor 28 and a single stocking 14. It will be understood, of course, that an identical description will likewise be applicable to the other air distributor 28 and the other stocking (not shown) except that the rotational positional of the shaft 62 in one air distributor 28 is offset by a predetermined amount, for example 135 degrees, from the shaft 62 in the other air distributor 28.

Referring then particularly to FIGS. 3 and 7–9, the interior housing chamber 100 is pressurized by the pressure source in the previously described fashion. This housing pressure in turn is communicated through the bore 120 and to the circumferential slot 122 in the air distributor plate 82.

Assuming that the air distributor plate 80 is initially in the position shown in FIG. 7, the air pressure is communicated to ports 200 and 202 in the port plate 52 thus pressurizing two adjacent tubular members in the stocking 14. At this time, and assuming rotation of the air distributor plate 80 in the direction of arrow A, the pressurization of a previous port 198 in the port plate 52 is in the process of being terminated.

Upon the continued rotation of the distributor plate 80 as shown in FIG. 8, the port 198 registers with a flat spot along the air distributor plate 80 and, as such, the tubular member 34 to which the port 198 is connected is held in a pressurized state. Likewise, the ports 200 and 202 continue to register with the slot 122 so that the tubular members 34 to which these two ports 200 and 202 are connected likewise remain pressurized.

Referring now to FIG. 9, upon the continued rotation of the air distributor 80, the first port 198 registers with the recess 124 in the air distributor plate so that the pressurized air from the tubular member 34 to which the port 198 is connected exhausts through the pressure port 198, through the recess 124 and out through the exhaust ports 58 on the port plate 52. Simultaneously, the port 200 registers with a flat spot on the air distributor plate 80 which maintains the pressure in the tubular member 34 connected to the port 200. Also simultaneously, the port 202 remains in registry with the pressurized slot 122 which maintains the air pressure at the port 202. Likewise simultaneously, the slot 122 registers with pressurizes the next port 204. Thereafter, the process depicted in FIGS. 7–9 is repeated as the air distributor plate 80 is rotatably driven by the shaft 62.

For the example shown in FIGS. 7–9, the port 198 in the port plate 52 is connected to the tubular member 34 in the stocking 14 immediately below the tubular member 34 to which the next port 200 is connected. Likewise, the port 202 is fluidly connected via the fluid line 30 to the tubular member 34 immediately above that which the port 200 is connected to and so on throughout the length of the stocking 14. In this fashion, the sequential pressurization and subsequent exhaustion of the fluid chambers 36 in the stocking 14 in effect ripples along the stocking 14 in a cephalic direction thus assisting the leg venous and skin circulation toward the patient's heart.

Although the air distributor 28 has been described solely in connection with the stocking 14 for assisting the leg venous and skin circulation on the lower extremity of a patient, it may be used in other applications than this. For example, the air distributor 28 could be used to selectively and sequentially inflate different portions of a bed mattress for an immobilized patient in order to prevent or minimize the occurrence of skin sores for such patients. Still other uses for the air distributor 28 are, of course, possible.

From the foregoing, it can be seen that the present invention provides a simple and yet effective means for assisting leg venous and skin circulation for immobilized patients. Such assistance not only minimizes the likelihood of thrombophlebitis but also the occurrence of decubitis ulcers due to the improved blood circulation. Moreover, the present device is virtually maintenance free and relatively inexpensive to construct.

Having described our invention, however, many modifications thereto will become apparent to those skilled in the art to which it pertains without deviation from the spirit of the invention as define by the scope of the appended claims.

We claim:

1. Apparatus to assist leg venous and skin circulation comprising:

a pair of stockings, one stocking being disposed around at least a portion of each leg of a person, said stockings each having a plurality of flexible members, each member defining an elongated and expandible fluid chamber, each fluid chamber extending substantially circumferentially around one of the person's leg, said chambers being axially adjacent each other;

means for sequentially and cyclically fluidly pressurizing said chambers in each stocking in a cephalic direction, maintaining the pressure in each chamber for a predetermined period of time and thereafter exhausting said fluid pressure from each chamber, said means comprising a source of fluid pressure and a fluid distributor having an inlet connected to said pressure source and a plurality of fluid outlets, each outlet being fluidly connected to one of said chambers so that upon pressurization of one of said chambers, the flexible member expands and compresses around the leg of the person; and wherein said pressurizing means comprises means for providing a relatively lengthy rest period for each stocking following the sequential pressurization of all of the chambers in each stocking during each pressurization cycle; and wherein said pressurizing means comprises means for offsetting the sequential pressurization of one stocking from the other stocking.

2. The invention as defined in claim 1 wherein said fluid is air.

3. The invention as defined in claim 2 wherein, following pressurization of each chamber, the air is exhausted to the atmosphere.

4. The invention as defined in claim 1 wherein said resilient members are immediately adjacent each other.

5. The invention as defined in claim 1 wherein said fluid distributor further comprises a housing having an interior chamber to which said inlet is connected, a shaft rotatably mounted to the housing and having a distributor plate with a port secured to one end of the shaft, said distributor plate flatly abutting against a port plate secured to the housing and said port plate having a plurality of circumferentially spaced outlet ports to which said outlets are connected, and motor means for rotatably driving said shaft so that said port in said distributor plate sequentially registers with said outlet ports to thereby fluidly connect said outlets with the interior of said housing.

6. The invention as defined in claim 5 wherein the distributor further comprises a plurality of exhaust ports formed through said port plate at a position radially spaced from the outlet ports, said exhaust ports having one end open exteriorly of said housing, and wherein said distributor plate includes a recess for sequentially connecting said outlet ports with said exhaust ports.

7. The invention as defined in claim 5 including resilient means for resiliently urging said distributor plate against said port plate to thereby fluidly seal said plates together.

8. The invention as defined in claim 5 wherein said distributor plate includes a circumferential groove on its side abutting said port plate, said groove extending across said distributor plate port and having a length sufficient to simultaneously connect said distributor plate port with two outlet ports in the port plate.

9. The invention as defined in claim 1 wherein the compression of the flexible member, upon pressurization, about the leg of the person is sufficient to substantially entirely compress the veins, but only minimally compress the arteries, of the person.

10. The invention as defined in claim 1 wherein said pressurizing means comprises a fluid distributor comprising:

a housing having a closed interior chamber;

means for pressurizing said chamber;

a port plate secured to one end of the housing and having a plurality of circumferentially spaced fluid ports formed through it, said port plate having a flat face facing said housing interior chamber;

a shaft rotatably mounted to said housing coaxially with said fluid ports;

a cylindrical distributor plate secured to one end of said shaft so that one axial end of the distributor plate flatly abuts against the flat face of said port plate, said distributor plate having a pressurizing port formed axially through it, said pressurized port having one end open to said housing chamber, said pressurizing port being radially spaced from the axis of rotation of said shaft by a distance equal to the radial position of said fluid ports on said port plate relative to the shaft axis so that upon rotation of said shaft, said pressurizing port is sequentially fluidly connected with said fluid ports; and means for rotatably driving said shaft.

11. The invention as defined in claim 10 wherein said port plate includes a plurality of circumferentially spaced exhaust ports extending axially entirely through said port plate and radially spaced from the fluid ports, each exhaust port being open at one end exteriorly of said housing and at its other end to said axial end of said distributor plate, and wherein said distributor plate includes a radially extending groove formed on said axial end of said distributor plate which sequentially fluidly connects said exhaust ports with said fluid ports upon the rotation of said distributor plate.

12. The invention as defined in claim 1 wherein said stockings are secured only around the legs of the patient.

* * * * *

UNITED STATES PATENT AND TRADEMARK OFFICE

CERTIFICATE OF CORRECTION

PATENT NO. : 4,311,135

DATED : January 19, 1982

INVENTOR(S) : Gerald G. Brueckner & Edward Cantrell

It is certified that error appears in the above—identified patent and that said Letters Patent is hereby corrected as shown below:

Column 1, line 29 & 30, delete "extend", insert --extent--.

column 4, line 15, delete "scured", insert --secured--.

column 5, line 11, delete "distancefrom", insert --distance from--.

Signed and Sealed this

*Twentieth* Day of *April 1982*

[SEAL]

*Attest:*

GERALD J. MOSSINGHOFF

*Attesting Officer*

*Commissioner of Patents and Trademarks*